US011558938B2

(12) United States Patent
Tsao et al.

(10) Patent No.: US 11,558,938 B2
(45) Date of Patent: Jan. 17, 2023

(54) MICROWAVE HEATING DEVICE AND MICROWAVE GUIDING TUBE THEREOF

(71) Applicant: WAVE POWER TECHNOLOGY INC., Toufen (TW)

(72) Inventors: Ming-Hsiung Tsao, Zhubei (TW); Hsuan-Hao Teng, Taichung (TW); Han-Ying Chen, Chupei (TW)

(73) Assignee: WAVE POWER TECHNOLOGY INC., Toufen (TW)

( * ) Notice: Subject to any disclaimer, the term of this patent is extended or adjusted under 35 U.S.C. 154(b) by 481 days.

(21) Appl. No.: 16/853,052

(22) Filed: Apr. 20, 2020

(65) Prior Publication Data

US 2021/0329750 A1 Oct. 21, 2021

(51) Int. Cl.
*H05B 6/78* (2006.01)
*H05B 6/80* (2006.01)
*H05B 6/66* (2006.01)

(52) U.S. Cl.
CPC ..... *H05B 6/784* (2013.01); *H05B 6/66* (2013.01); *H05B 2206/04* (2013.01)

(58) Field of Classification Search
CPC ..... H05B 2206/04; H05B 6/66; H05B 6/708; H05B 6/784
USPC ..... 219/678, 690, 691, 692, 693, 695, 697, 219/698, 700, 701
See application file for complete search history.

(56) References Cited

U.S. PATENT DOCUMENTS 4,227,063 A 10/1980 Edgar et al.
4,405,850 A 9/1983 Edgar
4,488,027 A 12/1984 Dudley et al.
5,298,707 A 3/1994 Sprecher et al.
5,958,275 A 9/1999 Joines et al.
6,259,077 B1 7/2001 Drozd et al.
7,034,266 B1 4/2006 DeGroot et al.
7,368,692 B1 * 5/2008 Hallac ..... H05B 6/788 219/745

(Continued)

FOREIGN PATENT DOCUMENTS

CN 2534763 Y 2/2003
CN 100516662 C 7/2009

(Continued)

OTHER PUBLICATIONS

Kashyap et al., A Waveguide Applicator for Sheet Materials, Feb. 1976, IEEE Transaction on Microwave Theory and Techniques.

*Primary Examiner* — Quang T Van
(74) *Attorney, Agent, or Firm* — Rabin & Berdo, P.C.

(57) ABSTRACT

The present invention is a microwave heating device and has a microwave guide tube, two microwave transmitting modules, and a transmission module. The microwave guide tube forms a wave travelling path and has at least one conveying opening pair and at least one waveguide plate pair. The at least one conveying opening pair has two conveying openings respectively disposed on two opposite walls of the microwave guide tube along a conveying direction. The at least one waveguide plate pair is disposed in the microwave guide tube and has two waveguide plates parallel with the wave travelling path. The two microwave transmitting modules are disposed on two opposite ends of the microwave guide tube. The transmission module extends through the at least one conveying opening pair along the conveying direction.

76 Claims, 17 Drawing Sheets

(56) References Cited

U.S. PATENT DOCUMENTS

| | | | | |
|---|---|---|---|---|
| 9,849,708 | B1 * | 12/2017 | Ernst | B41M 7/0081 |
| 2015/0136761 | A1 | 5/2015 | Jung et al. | |

FOREIGN PATENT DOCUMENTS

| | | | |
|---|---|---|---|
| CN | 107062854 | A | 8/2017 |
| CN | 208623940 | U | 3/2019 |
| FR | 1264758 | A | 6/1961 |
| FR | 1589265 | A | 3/1970 |
| JP | 5377458 | | 12/1976 |
| JP | S60240094 | A | 11/1985 |
| JP | H0340798 | U | 4/1991 |
| JP | H08507679 | A | 8/1996 |
| JP | H10112386 | A | 4/1998 |
| JP | 2004031222 | A | 1/2004 |
| JP | 2005066451 | A | 3/2005 |
| JP | 2009181900 | A | 8/2009 |
| JP | 2018085680 | A | 5/2018 |
| TW | 197379 | B | 1/1993 |
| TW | I293341 | B | 2/2008 |
| TW | I641791 | B | 11/2018 |
| TW | I678502 | B | 12/2019 |

* cited by examiner

MICROWAVE HEATING DEVICE AND MICROWAVE GUIDING TUBE THEREOF

BACKGROUND OF THE INVENTION

1. Field of the Invention

The present invention relates to a microwave heating device and a microwave guiding tube thereof, and particularly to a microwave heating device and a microwave guiding tube thereof that may heat both high microwave absorbing materials and low microwave absorbing materials uniformly.

2. Description of Related Art

Conventional microwave heating devices in the prior art can be mainly classified into the following three types. First, closed resonant cavity: the principle of the closed resonant cavity is to move or rotate a heated object in the closed resonant cavity to reduce the heating unevenness for the heated object caused by the microwave hot spots and cold spots in the closed resonant cavity. Second, open resonance cavity: the principle is similar to the closed resonance cavity, the heated object is heated by a continuous flow through standing wave hot spots in the open resonance cavity, the heated object is ionized, and the closed resonance cavity is mainly used in light source production such as sulfur lamps or disposal. Third, travelling wave heater: the principle is to heat the heated object by a travelling wave along the microwave transmission path to avoid heating unevenness caused by hot spots and cold spot effects of standing waves.

Among them, the closed resonance cavity and the open resonance cavity use the standing waves to heat the heated object. However, the standing wave will form obvious hot spots and cold spots in the cavity, and the heated object cannot be heated uniformly. In practice, it can only be applied to markets with low unit prices, such as wood dehydration or tobacco drying.

Although the travelling wave heater does not form obvious hot and cold spots, when the heated object is a low microwave absorption material, the travelling wave heater can uniformly heat the heated object. However, when the heated object is a high microwave absorbing material, the microwave energy will be quickly absorbed by the heated object to be heated which is close to the heating source, resulting in that the heated object which is far from the heating source cannot be sufficiently heated, and the object to be heated cannot be uniformly heated. Therefore, the conventional microwave heating device in the prior art needs to be improved.

To overcome the shortcomings of the conventional microwave heating devices, the present invention provides a microwave heating device and a microwave guiding tube thereof.

SUMMARY OF THE INVENTION

The main objective of the present invention is to provide a microwave heating device and a microwave guiding tube thereof, and particularly to a microwave heating device and a microwave guiding tube thereof that may heat both high microwave absorbing materials and low microwave absorbing materials uniformly.

The microwave heating device in accordance with the present invention has a microwave guide tube forming a wave travelling path and having at least one heating segment and each one of the at least one heating segment having a front opening wall;

a rear opening wall disposed at a spaced interval with the front opening wall along a conveying direction;

a top wall connected to the front opening wall and the rear opening wall; and a bottom wall connected to the front opening wall and the rear opening wall and facing the top wall;

at least one conveying opening pair, and each one of the at least one conveying opening pair having two conveying openings respectively formed through the front opening wall and the rear opening wall of the at least one heating segment;

at least one waveguide plate pair disposed in the at least one heating segment, and each one of the at least one waveguide plate pair having a position corresponding to a position of the at least one conveying opening pair along the wave travelling path; and two waveguide plates respectively disposed on the top wall and the bottom wall of the at least one heating segment, extending along the wave travelling path, and made of a dielectric material;

two microwave transmitting modules respectively disposed on two opposite ends of the microwave guide tube along the wave travelling path; and a transmission module extending through the at least one conveying opening pair along the conveying direction.

The microwave guiding tube of the microwave heating device in accordance with the present invention has at least one heating segment and each one of the at least one heating segment having a front opening wall;

a rear opening wall disposed at a spaced interval with the front opening wall along a conveying direction;

a top wall connected to the front opening wall and the rear opening wall; and a bottom wall connected to the front opening wall and the rear opening wall and facing the top wall;

at least one conveying opening pair, and each one of the at least one conveying opening pair having two conveying openings respectively formed through the front opening wall and the rear opening wall of the at least one heating segment;

at least one waveguide plate pair disposed in the at least one heating segment, and each one of the at least one waveguide plate pair having a position corresponding to a position of the at least one conveying opening pair along the wave travelling path; and two waveguide plates respectively disposed on the top wall and the bottom wall of the at least one heating segment, extending along the wave travelling path, and made of a dielectric material.

Other objects, advantages and novel features of the present invention will become more apparent from the following detailed description when taken in conjunction with the accompanying drawings.

DETAILED DESCRIPTION OF THE PREFERRED EMBODIMENT

Figure 1:
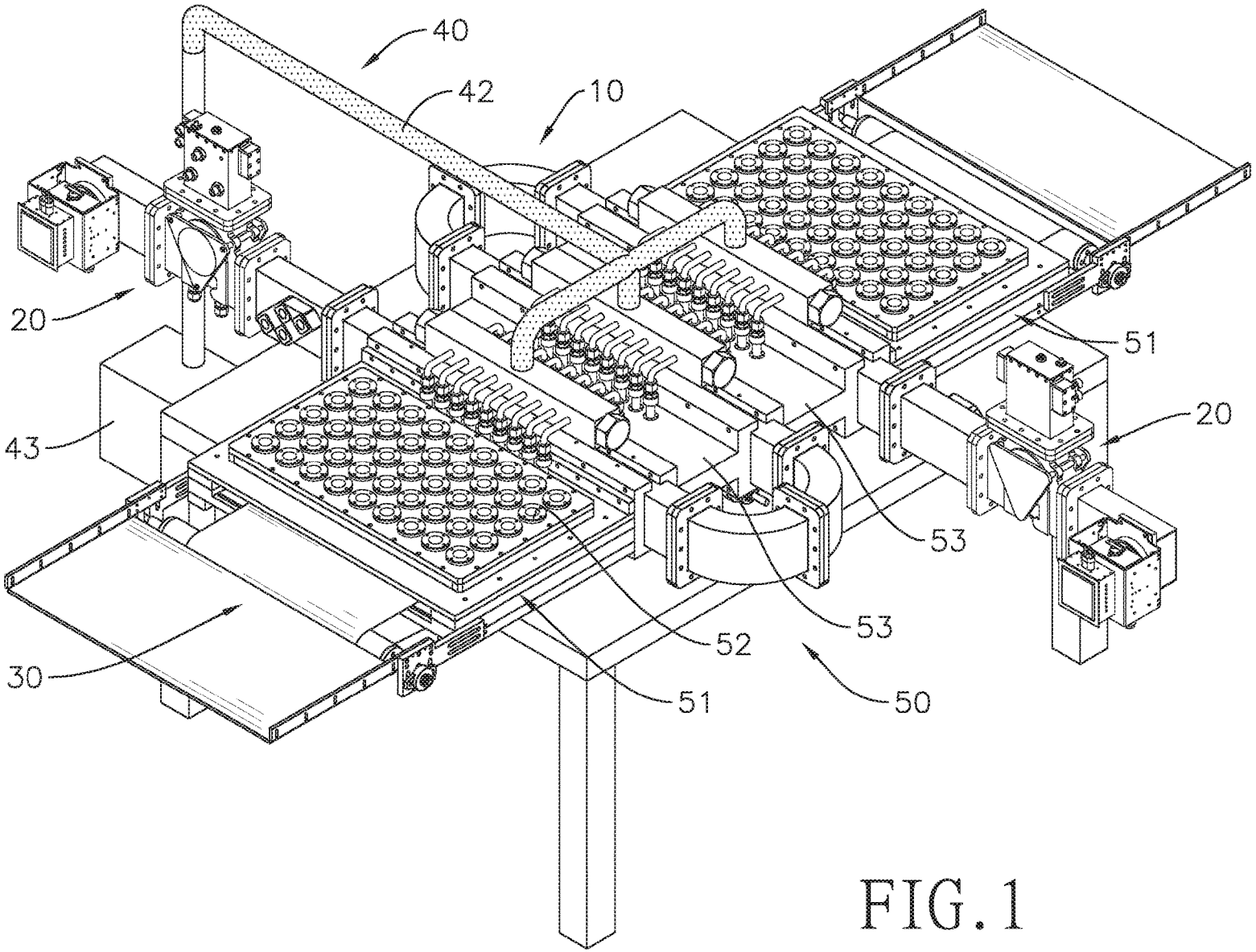
FIG. 1 is a perspective view of a first embodiment of a microwave heating device in accordance with the present invention.

With reference to FIGS. 1 to 4, a first embodiment of a microwave heating device in accordance with the present invention includes a microwave guide tube 10, two microwave transmitting modules 20, a transmission module 30, a suction module 40, and an isolation module 50.

In the first embodiment of the present invention, the microwave guide tube 10 has multiple heating segments 11 and multiple connecting segments 12. The heating segments 11 are arranged in parallel at spaced intervals along a conveying direction D of the transmission module 30. Each connecting segment 12 is connected to two adjacent ones of the heating segments 11. In the first embodiment of the present invention, each heating segment 11 may be a straight pipe, and each connecting segment 12 may be a curved pipe. With the heating segments 11 and the connecting segments 12, the microwave guide tube 10 is formed into a S-shaped tube to have a S-shaped wave travelling path. Furthermore, the microwave guide tube 10 may be a pipe whose two open ends communicate with each other, so the microwave guide tube 10 may only have one single tubular heating segment 11.

The two microwave transmitting modules 20 respectively are connected to two opposite ends of the microwave guide tube 10 along the wave travelling path. Each one of the two microwave transmitting modules 20 emits microwaves from one of the two opposite ends of the microwave guide tube 10 to the other one of the two opposite ends of the microwave guide tube 10 along the wave travelling path of the microwave guide tube 10. When a heated object is heated in the microwave guide tube 10, even if a distance between the heated object and one of the two microwave transmitting modules 20 is different, the heating power of each heated object by the responsive one of the microwave transmitting modules 20 is different, and the difference can be complementary to the other one of the two microwave transmitting modules 20, making a total beating power to each heated object more uniform. Specifically, if the percentage of microwave energy absorbed by the heated object is defined as the use efficiency, the maximum value ($P_{max}$) of the microwave energy absorbed by the heated object minus the minimum value ($P_{min}$) along the wave travelling path divided by the average value ($P_{average}$) is defined as the uniformity. That is, the uniformity (%) is $$\frac{P_{max} - P_{min}}{P_{average}}.$$

From the calculation results in Table 1, it can be known that under the same use efficiency, the use of two microwave transmitting modules 20 can greatly improve the uniformity of heating.

TABLE 1

Relation between uniformity and use efficiency of one single microwave transmission module 20 and two microwave transmission modules 20:

| Use Efficiency | Uniformity of single microwave transmitting module | Uniformity of two microwave transmitting modules |
|---|---|---|
| 95% | 297.03% | 93.88% |
| 85% | 188.49% | 41.44% |
| 75% | 137.83% | 22.87% |
| 65% | 104.41% | 13.33% |
| 55% | 79.43% | 7.79% |
| 45% | 59.47% | 4.39% |
| 35% | 42.86% | 2.29% |
| 25% | 28.65% | 1.02% |

In the first embodiment of the present invention, each one of the two microwave transmitting modules 20 emits microwaves with a frequency of 2450 MHz toward the microwave guide tube 10, and a cross-sectional shape of the microwave guide tube 10 corresponds to the microwave at the frequency, and adopts a WR340 rectangular cross section defined by the Electronic Industries Alliance (EIA). The rectangular cross section allows the microwave to work in $TE_{10}$ mode to reduce complexity, but the microwave frequency emitted by each one of the two microwave transmitting modules 20 is not limited to 2450 MHz.

Furthermore, in the first embodiment of the present invention, each microwave transmitting module 20 has a microwave source 21, a circulator 22, a directional coupler 23, and a water loader 24. The microwave source 21 and the directional coupler 23 are respectively disposed at two ends of the microwave transmitting module 20. The circulator 22 is connected to the microwave source 21 and the directional coupler 23. The water loader 24 is connected to one side of the circulator 22. The directional coupler 23 is connected to one of the two opposite ends of the microwave guide tube 10. The circulator 22 controls the microwaves transmitting in a specific direction by using the gyro-magnetic phenomenon, thereby protecting the microwave source 21. The directional coupler 23 can measure the microwave power transmitted by the microwave transmitting module 20 toward the microwave guide tube 10 and the microwave power transmitted by the microwave guide tube 10 toward the microwave transmitting module 20.

Figure 3:
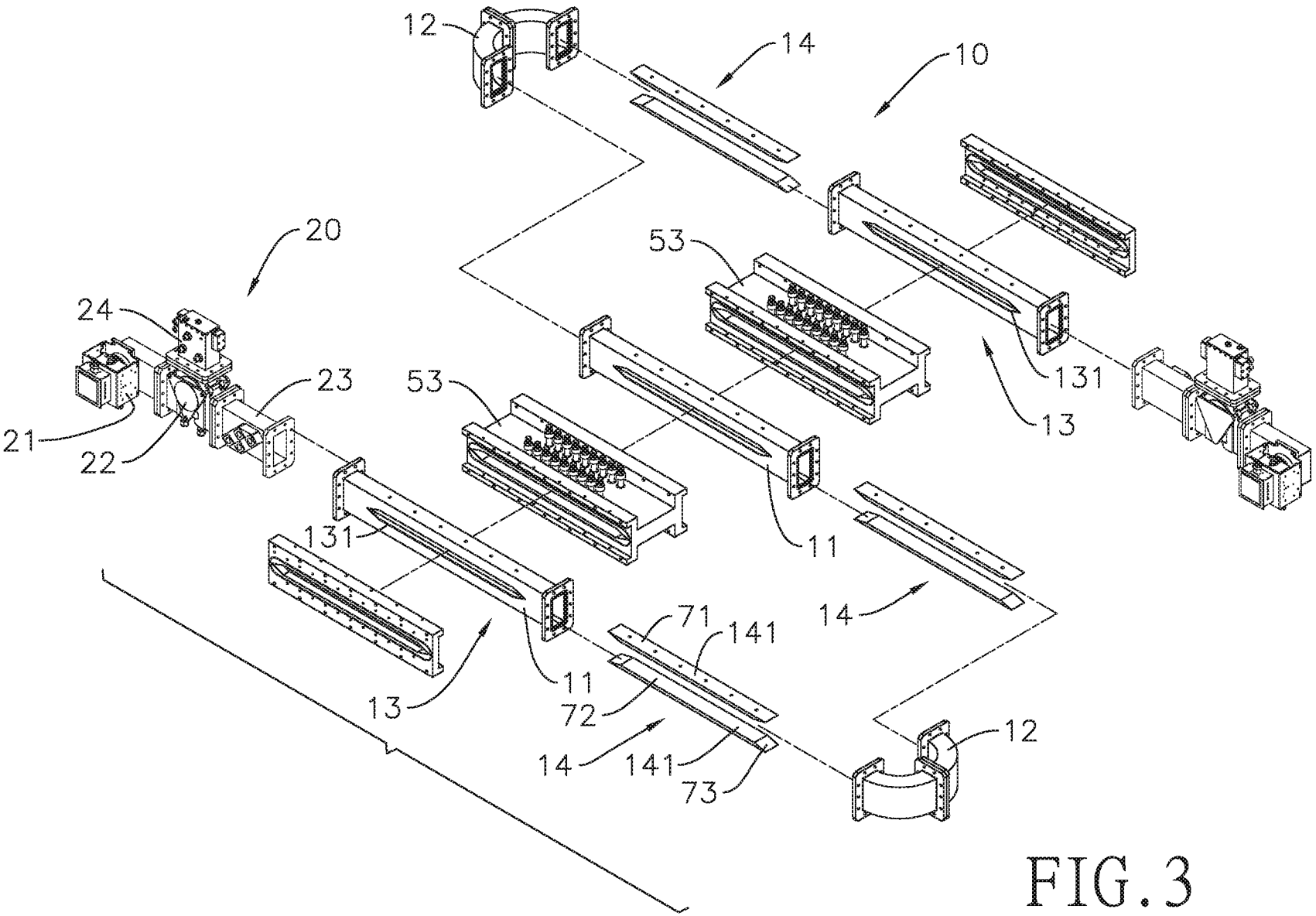
FIG. 3 is a further enlarged exploded perspective view of the microwave heating device in FIG. 1.
Figure 4:
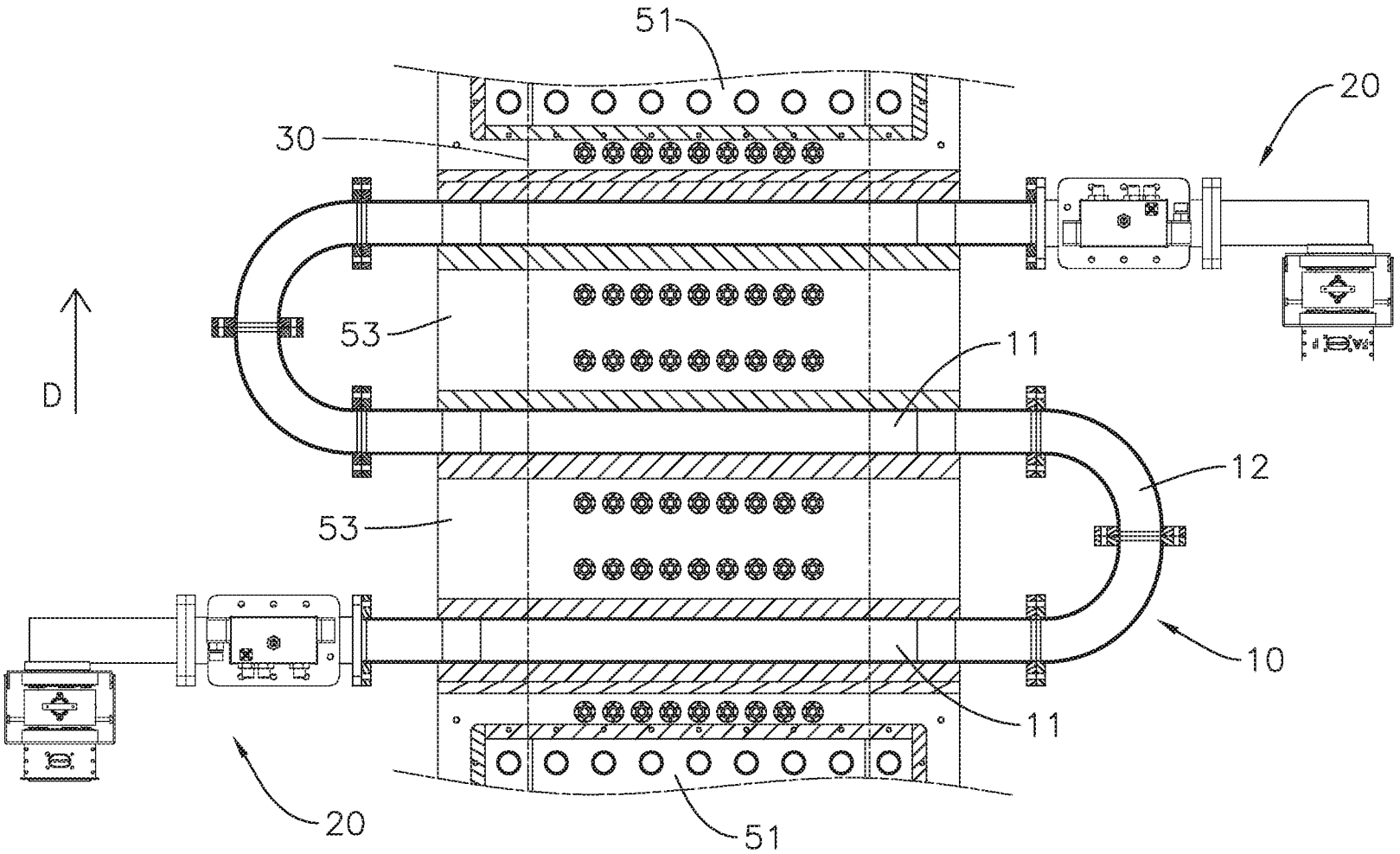
FIG. 4 is a side view in partial section of the microwave heating device shown in FIG. 1.
Figure 5:
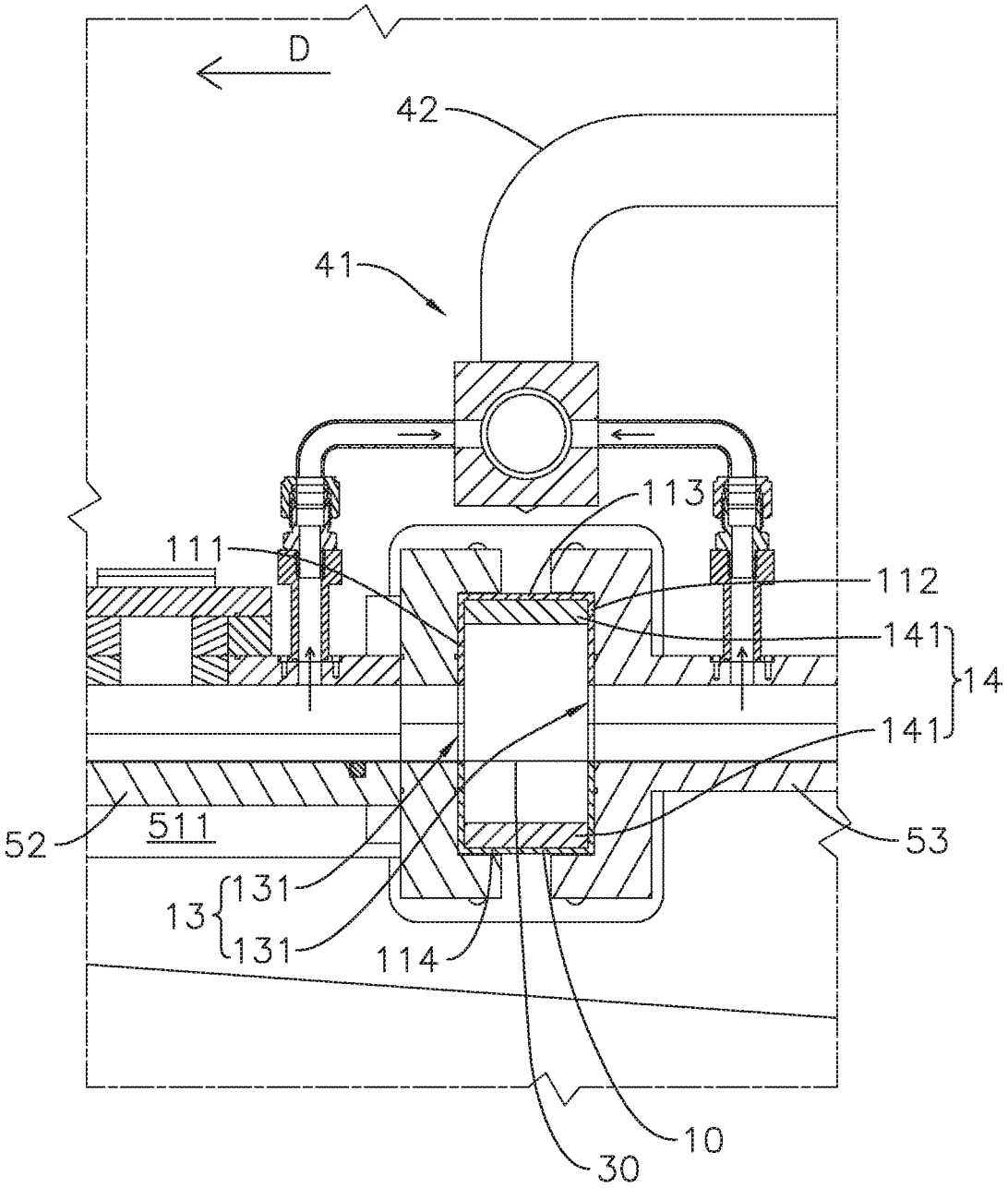
FIG. 5 is an enlarged side view of the microwave heating device shown in FIG. 1.
Figure 6:
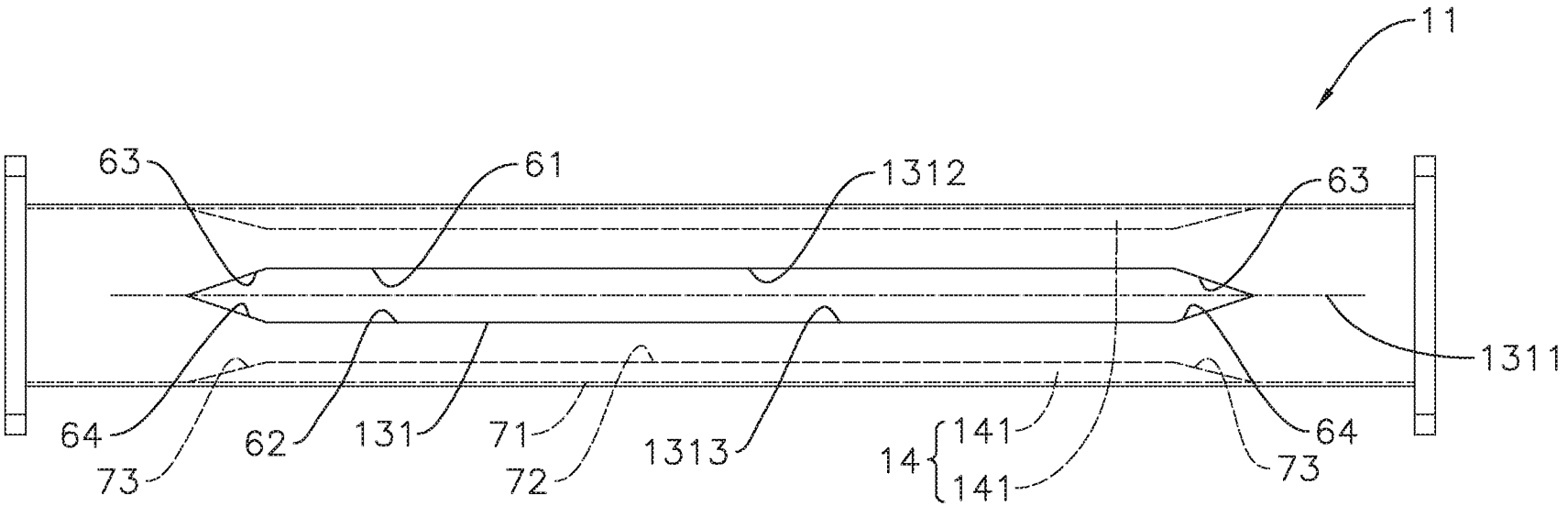
FIG. 6 is a side view of a heating segment of the first embodiment of the microwave heating device in FIG. 1.

With reference to FIGS. 3, 5, and 6, each heating segment 11 of the microwave guide tube 10 has a conveying opening pair 13, each conveying opening pair 13 has two conveying openings 131 extending along the wave travelling path, and the two conveying openings 131 are respectively formed through two opposite endwalls of a responsive one of the heating segments 11 along the conveying direction D of the transmission module 30.

In detail, with reference to FIG. 3, FIG. 5, and FIG. 6, each heating segment 11 of the microwave guide tube 10 has a front opening wall 111, a rear opening wall 112, a top wall 113, and a bottom wall 114. The front opening wall 111 and the rear opening wall 112 are arranged at a spaced interval along the conveying direction D of the transmission module 30. The top wall 113 and the bottom wall 114 are connected to the front opening wall 111 and the rear opening wall 112, and the top wall 113 and the bottom wall 114 are opposite to each other. The two conveying openings 131 of the conveying opening pair 13 are respectively formed through the front opening wall 111 and the rear opening wall 112 of the heating section 11.

The transmission module 30 extends through each conveying opening pair 13 of the microwave guide tube 10 along the conveying direction D. Preferably, the transmission module 30 is a conveying belt, and makes the heated object pass through each heating segment 11 of the microwave guide tube 10 sequentially via the conveying opening pairs 13 along the conveying direction D. During the process of passing through each heating segment 11 of the microwave guide tube 10, the heated object absorbs the microwave energy emitted by the microwave transmitting modules 20 and is heated.

In the first embodiment of the present invention, each conveying opening 131 of the microwave guide tube 10 has a middle line 1311, a top peripheral edge 1312, and a bottom peripheral edge 1313. The top peripheral edge 1312 and the bottom peripheral edge 1313 are respectively disposed on two sides of the middle line 1311. A distance between the top peripheral edge 1312 and the bottom peripheral edge 1313 is defined as an opening width of the conveying opening 131. The opening widths of the opposite ends of each conveying opening 131 along the wave travelling path are respectively tapered, thereby improving the impedance matching effect of the microwave on the wave travelling path in the microwave guide tube 10, so that the heated object in the microwave guide tube 10 is heated more uniformly.

The specific shapes of the opposite ends of each conveying opening 131 are described as follows: the top peripheral edge 1312 of each conveying opening 131 has a top main segment 61 and two upper necked segments. The top main segment 61 extends along the wave travelling path, and the two upper necked segments are respectively connected to the opposite ends of the top main segment 61 along the wave travelling path. The bottom peripheral edge 1313 of each conveying opening 131 has a bottom main segment 62 and two lower necked segments. The bottom main segment 62 extends along the wave travelling path, and the two lower necked segments are connected to two opposite ends of the bottom main segment 62 along the wave travelling path. The upper and lower necked segments of each conveying opening 131 along the wave travelling path at a responsive one of the two opposite ends of the conveying opening 131 extend toward the middle line 1311, and two distal ends of the upper and lower necked segments are connected to each other to form one of the two opposite ends of the conveying opening 131. In order to further adjust the impedance matching, the shape of the upper and lower necked segments may be one of the following four types:

First, linear gradation: each necked segment (i.e. upper necked segment and lower necked segment) is a straight line, that is, each upper necked segment is a first upper straight segment 63, and each lower necked segment is a first bottom straight segment 64.

Figure 7:
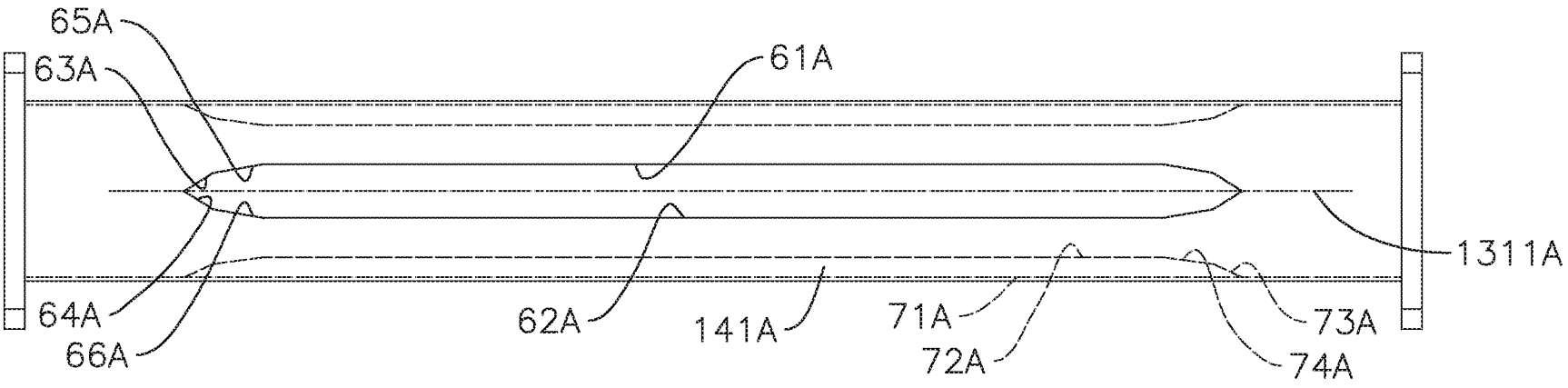
FIG. 7 is a side view of a heating segment of a second embodiment of a microwave heating device in accordance with the present invention.
Figure 8:
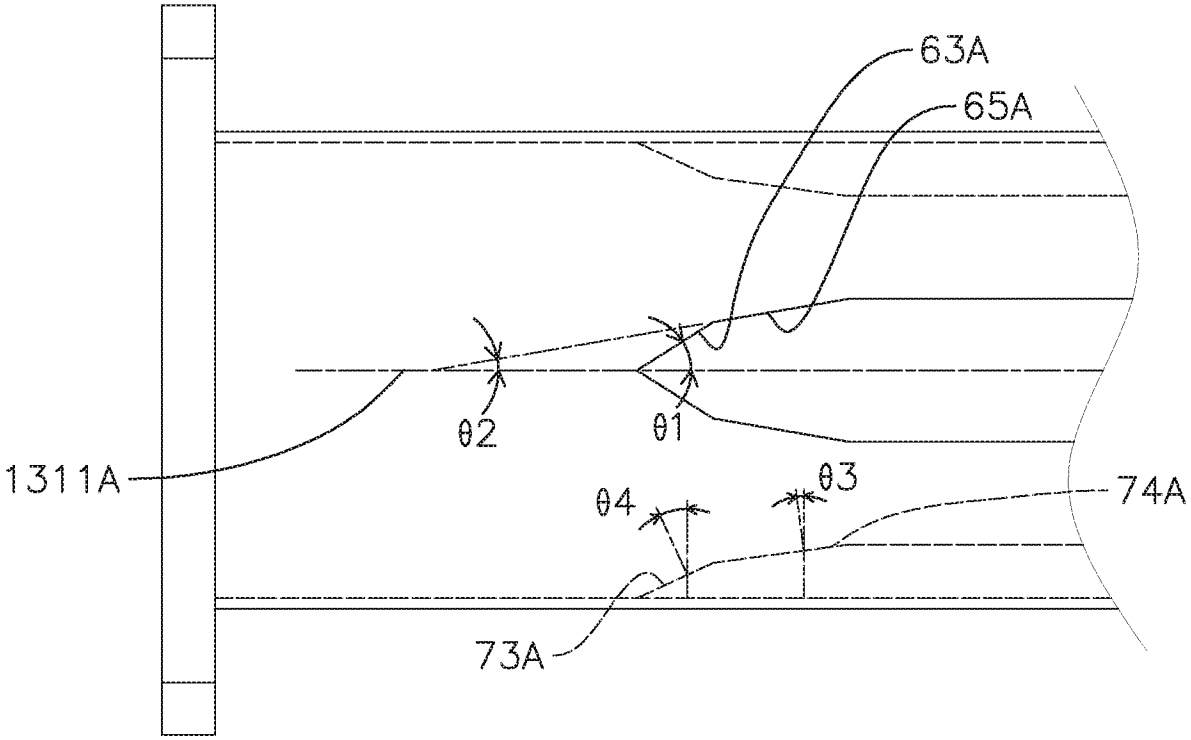
FIG. 8 is an enlarged side view of the heating segment of the second embodiment of the microwave heating device in FIG. 7.

Second, multi-vertex structure: each necked segment (i.e. upper necked segment and lower necked segment) has more than two connected straight segments, such as a second embodiment of this present invention as shown in FIGS. 7 and 8. That is, each upper necked segment has a first upper straight segment 63A and a second upper straight segment 65A, and the second upper straight segment 65A is located between the corresponding first upper straight segment 63A and the top main segment 61A. An angle $\theta_1$ between the first upper straight segment 63A and the middle line 1311A is larger than an angle $\theta_2$ between the second upper straight segment 65A and the middle line 1311A. Each lower necked segment has a first lower straight segment 64A and a second lower straight segment 66A, and the second lower straight segment 66A is located between the corresponding first lower straight segment 64A and the bottom main segment 62A. An angle between the first lower straight segment 64A and the middle line 1311A is larger than an angle between the second lower straight segment 66A and the middle line 1311A.

Among them, the first upper straight segment 63A is connected to an end of the second upper straight segment 65A extending toward the middle line 1311A. In the second embodiment of the present invention, a length of each straight segment and the included angle with the middle line 1311A can be designed according to the theory of Chebyshev Multi-section Matching Transformer to reduce the size of the system in the use of the frequency and get the best match within the range.

Figure 9:
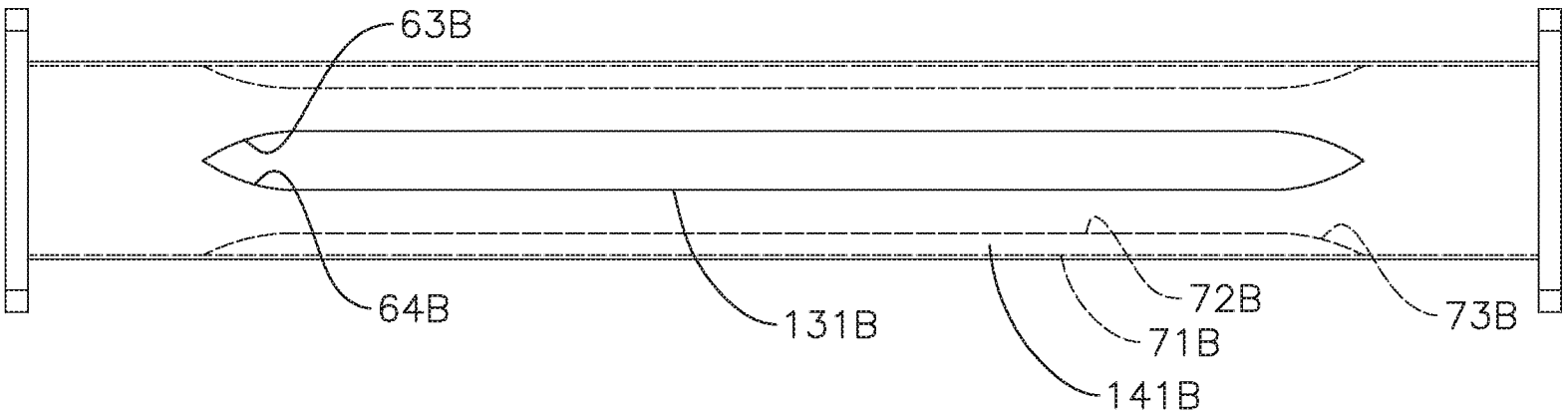
FIG. 9 is a side view of a heating segment of a third embodiment of a microwave heating device in accordance with the present invention.

Third, curvature gradient: each necked segment (i.e. upper necked segment and lower necked segment) is an arc; for example, in a third embodiment of the present invention as shown in FIG. 9, each upper necked segment is a first upper arc segment 63B, and the first upper arc segment 63B preferably protrudes toward an outside of the conveying opening 131B, each lower necked segment is a first lower arc segment 64B, and the first lower arc segment 64B is preferably toward the outside of the conveying opening 131B.

Figure 10:
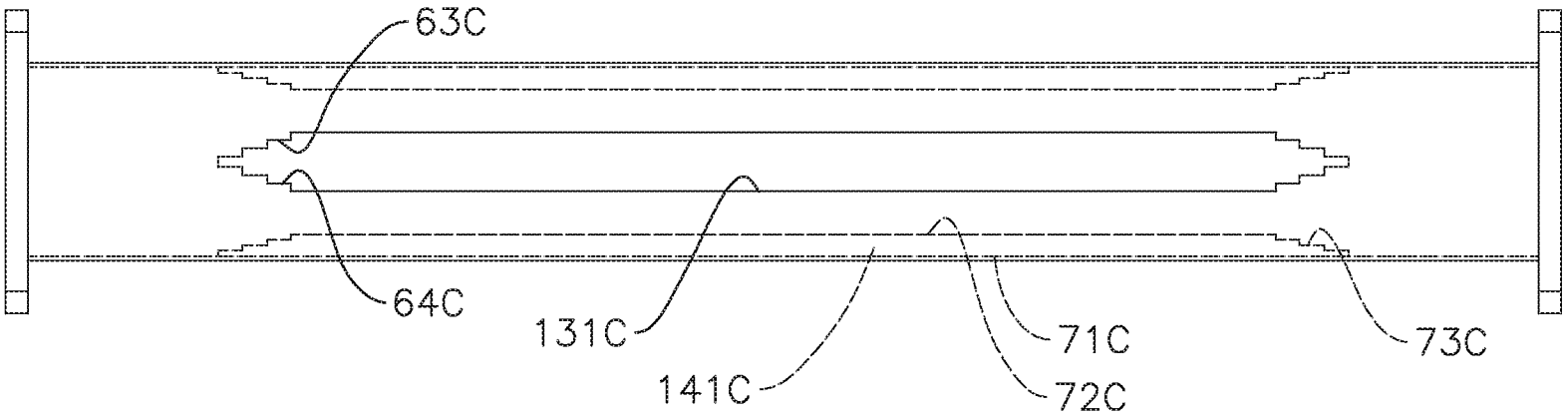
FIG. 10 is a side view of a heating segment of a fourth embodiment of a microwave heating device in accordance with the present invention.

Fourth, stepped structure: each necked segment (i.e. the upper necked segment and the lower necked segment) is a stepped shape. For example, in a fourth embodiment of the present invention as shown in FIG. 10, each upper necked segment is an upper stepped segment 63C, and each lower necked segment is a lower stepped segment 64C. A distance between the upper stepped segment 63C and the lower stepped segment 64C is gradually reduced away from a center of the conveying opening 131C. Each stepped segment 63C, 64C in the fourth embodiment of the present invention forms multiple right angles, but each stepped segment 63C, 64C may form only a right angle. The size of each stepped segment 63C, 64C can be designed according to the theory of Chebyshev Multi-section Matching Transformer, in order to achieve the purpose of reducing the size of the system, and the best matching effect can be obtained in the frequency range of use.

In the foregoing embodiments, the shapes and positions of the upper and lower necked segments of each conveying opening 131 are symmetrical to each other, but are not limited thereto.

With reference to FIGS. 3, 5, and 6, in the first embodiment of the present invention, the microwave guide tube 10 further has multiple waveguide plate pairs 14 respectively disposed in the heating segments 11. That is, each conveying opening pair 13 is correspondingly provided with a waveguide plate pair 14. A position of each waveguide pair 14 on the wave travelling path corresponds to the position of the conveying opening pair 13 in the same heating segment 11 on the wave travelling path. Each waveguide plate pair 14 has two waveguide plates 141, which are respectively connected to the top wall 113 and the bottom wall 114 of the respective one of the heating segments 11, and extend along the wave travelling path. Each waveguide plate 141 is made of a dielectric material, and is preferably made of alumina ceramic, but is not limited thereto. Each waveguide plate 141 may also be made of aluminum nitride ceramic having better thermal conductivity than alumina ceramic or boron nitride ceramic. The waveguide plate pair 14 can modulate a wave travelling mode of the microwave in the microwave guide tube 10, so that it changes from an original fundamental mode $TE_{10}$ to a specific higher-order mode, and it has the following effects:

First, when the microwave absorption characteristics of the heated object are strong, the waveguide plate pair 14 can still uniformly heat the heated object.

Second, when a metal object appears in a conventional microwave guide tube, the microwave in the conventional microwave guide tube will be completely reflected by the metal object back to an incident end. That is, the impedance fails, resulting in the conventional microwave guide tube not able to heat a heated object that contains metal. However, even if the heated object in the microwave guide tube 10 of the present invention is mixed with metal, the microwave can still bypass the metal object as usual and uniformly heat the heated object.

By providing the waveguide plate pair 14, the present invention can process materials with strong microwave absorption characteristics and heated objects that contain metal, thereby enlarging the range of materials that can be heated by the present invention. Therefore, the present invention can heat heated objects with high unit price that the conventional microwave heating devices cannot heat, such as wet circuit boards, various electronic products containing metal components, semiconductor wafers containing metal, solar wafers containing metal wires, and wet clothing with metal accessories, and this may increase the value of the present invention.

In the embodiments of the present invention, the positions of the waveguide plate pairs 14 and the conveying opening pairs 13 correspond to each other. Specifically, the center of mass of each waveguide plate 141 and the shape center of each conveying opening 131 in each heating segment 11 are located on the same plane, but it is not limited to this. As long as the position of the waveguide plate 141 is substantially the same as the position of the conveying opening 131, the waveguide plate 141 can adjust the impedance matching of the microwave guide tube 10, and the heated objects can be heated evenly when passing through the microwave guide tube 10.

In detail, in the travelling wave heating method, the magnitude of the microwave energy in the heated object along a travelling direction is $P_{propagation}(z)=P_0e^{-\alpha z}$. Along the travelling direction of the microwave, the amount of energy absorbed by the material within a unit distance is $P_{absorptoin}(z)=\alpha P_0e^{-\alpha z}$, wherein $P_0$ is the initial incident energy, $\alpha$ is the attenuation coefficient, and the value of $\alpha$ is not only determined by the dielectric constant and dielectric loss of the material, but also by the frequency of the travelling wave and the mode used.

Figure 15:
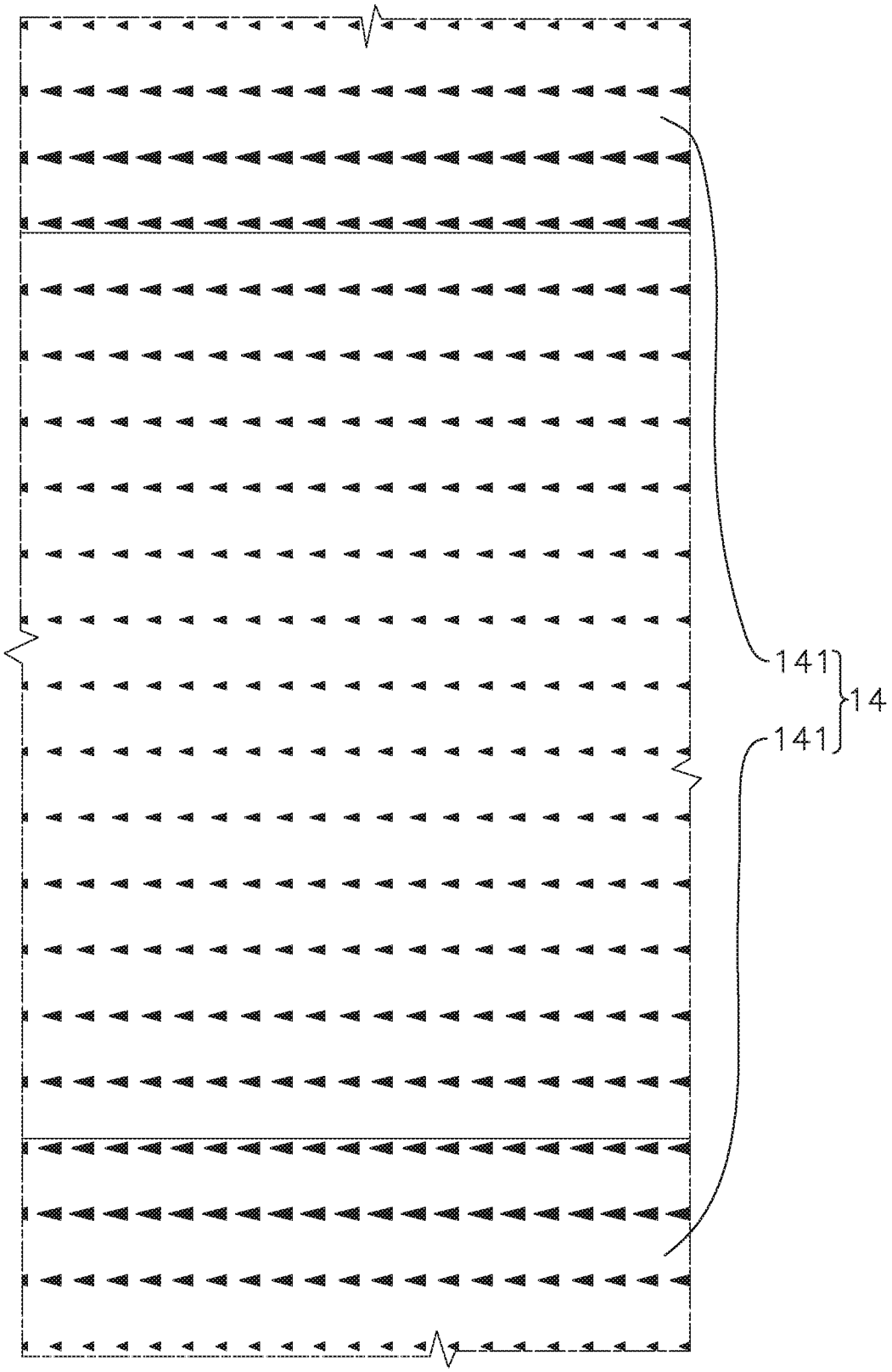
FIG. 15 is a microwave electric field diagram of the microwave guide tube as shown in FIG. 5.
Figure 16:
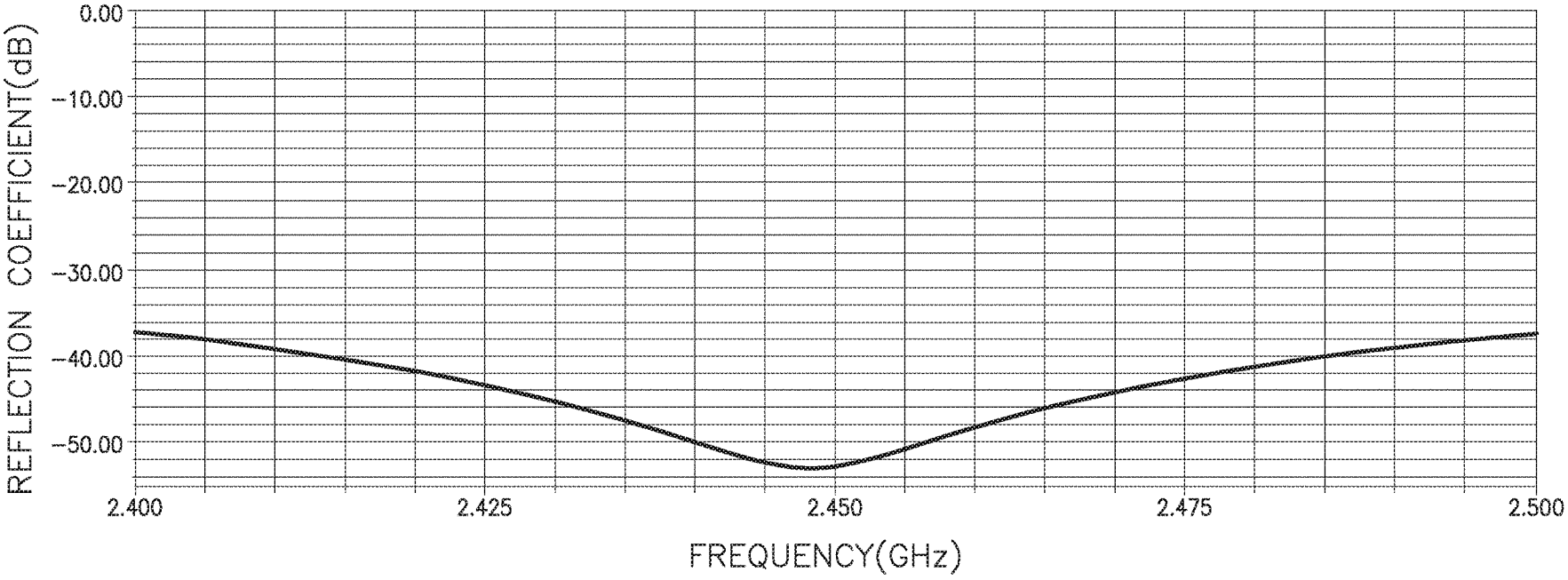
FIG. 16 is a diagram of reflection coefficient and frequency of mode conversion impedance matching of the microwave guide tube in the waveguide plate pair.
Figure 17:
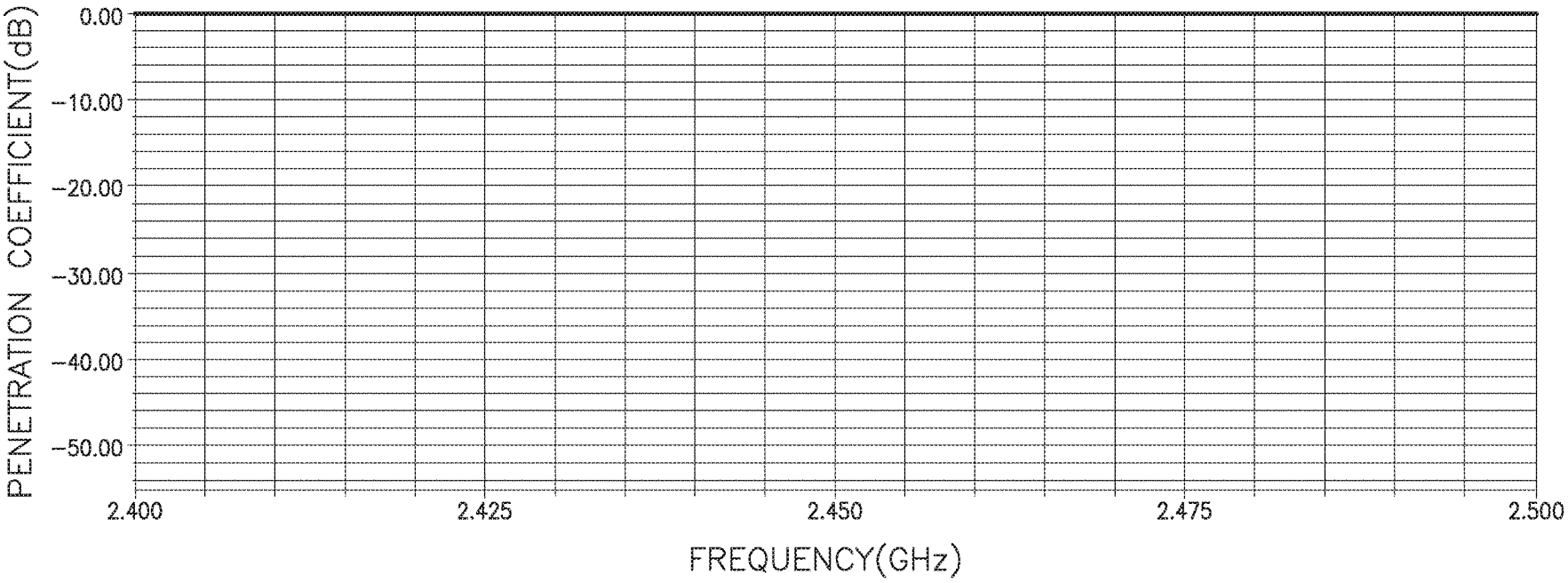
FIG. 17 is a diagram of penetration coefficient and frequency of mode conversion impedance matching of the microwave guide tube in the waveguide plate pair.

With reference to FIGS. 5, 15, and 16, by using the waveguide plate pairs 14 made of dielectric material in the microwave guide tube 10, the waveguide plate pairs 14 will change the wave travelling mode from the original fundamental mode $TE_{10}$ to a higher-order parallel electric field of a TE mode. In the parallel electric field mode, the direction of the microwave electric field is parallel to the conveying direction D. Specifically, the wave travelling mode between the two waveguide plates 141 of the waveguide plate pair 14 is completely converted from the fundamental mode $TE_{10}$ to the TE mode as shown in FIG. 15. The relationship between reflection S11 parameters (i.e. reflection coefficient) and frequency corresponding to impedance matching is shown in FIG. 16, wherein the horizontal coordinate unit is Ghz and the vertical coordinate unit is dB. In addition, with reference to FIG. 17, the relationship between the penetration S21 parameter (that is, the penetration coefficient) and the frequency corresponding to the impedance mode conversion from the fundamental mode $TE_{10}$ to the TE mode in FIG. 15 is OdB in the entire frequency band.

The advantage of transforming the travelling wave mode from the original fundamental mode $TE_{10}$ to the parallel electric field mode is that the attenuation coefficient can be adjusted. So even if the microwave absorption characteristics of the heated object are strong, the waveguide plate pairs 14 can heat the heated object uniformly. The problem that the conventional microwave heating device can only heat front edges of two ends of the heated object is resolved. In addition, the parallel electric field mode enables the microwave to bypass the metal object, and thereby even if the heated object is mixed with a metal object, the microwave can still bypass the metal object and uniformly heat the heated object as usual.

Furthermore, in the embodiments of the present invention, the thicknesses of two opposite ends of each waveguide plate 141 are gradually reduced toward a center away from the waveguide plate 141 to further improve impedance matching. In order to further adjust the impedance matching, the thickness reduction type of the two opposite ends of the waveguide plate 141 is also the same as that of the two opposite ends of the conveying opening 131 as described above and includes four types:

First, linear gradation: the specific shapes of the two opposite ends of each waveguide plate 141 are shown in FIG. 6. The waveguide plate 141 has two sides, an abutting face 71, a main face 72, and two first inclined faces 73. The abutting face 71 is disposed on one of the two sides of the waveguide plate 141 that is connected to the microwave guide tube 10 and extends along the wave travelling path. The main face 72 is disposed on the other one of the two sides of the waveguide plate 141 along the wave travelling path and has a length shorter than a length of the abutting face 71 along the wave travelling path. The two first inclined faces 73 are respectively connected to two sides of the main face 72 and respectively extend to two sides of the abutting face 71 to form the two opposite ends of the waveguide plate 141 along the wave travelling path. In the first embodiment of the present invention, the shape of the waveguide plate 141 is an isosceles trapezoid when viewed from the conveying direction D.

Second, multi-vertex structure: with reference to FIGS. 7 and 8, in the second embodiment of the present invention, the structure of the waveguide plate 141A with a vertex structure at two ends is substantially the same as that of the waveguide plate 141 with linear gradation at two ends. The difference is that the waveguide plate 141A further has two second inclined faces 74A, and each one of the second inclined faces 74A is disposed between one of the first inclined faces 73A and the main face 72A. The degree of tilt of the second inclined face 74A of each waveguide plate 141A relative to the abutting face 71A is lesser than that of the first inclined face 73A relative to the abutting face 71A. That is, an angle $\theta_3$ between a normal line of the second inclined face 74A and a normal line of the abutting face 71A is smaller than an angle $\theta_4$ between a normal line of the first inclined face 73A and the normal line of the abutting face 71A. In addition, in other embodiments, multiple inclined faces with different inclination degrees may be connected between the first inclined face 73A and the main face 72A, so that the edge of the waveguide plate 141 in the second embodiment is formed with multiple folding points. In addition, the size of each inclined face can be designed according to the theory of Chebyshev Multi-section Matching Transformer to achieve the best matching effect.

Third, curvature gradient: with reference to FIG. 9, in the third embodiment of the present invention, the structure of the waveguide plate 141B with curvature gradient at two ends is substantially the same as that of the waveguide plate 141 with linear gradation at two ends. The difference is that the two curved faces 73B are disposed on two opposite ends of the main face 72B along the wave travelling path, and the two curved faces 73B extend to the abutting face 71B respectively from the two opposite ends of the main face 72B to form the two opposite ends of the waveguide plate 141B along the wave travelling path. Each one of the curved faces 73B preferably protrudes toward an outside of the waveguide plate 141B.

Fourth, stepped structure: with reference to FIG. 10, in the fourth embodiment of the present invention, the structure of the waveguide plate 141C with stepped structure at two ends is substantially the same as that of the waveguide plate 141 with linear gradation at two ends. The difference is that the two stepped faces 73C are disposed on two opposite ends of the main face 72C along the wave travelling path, and the two stepped faces 73C extend to the abutting face 71C respectively from the two opposite ends of the main face 72C to form the opposite ends of the waveguide plate 141C along the wave travelling path. Each one of the stepped faces 73C in the fourth embodiment of the present invention forms multiple right-angled portions, but each stepped face 73C may form only a right-angled portion. The size of each stepped face 73C can be designed according to the theory of the Chebyshev Multi-section Matching Transformer to achieve the best matching effect.

Figure 2:
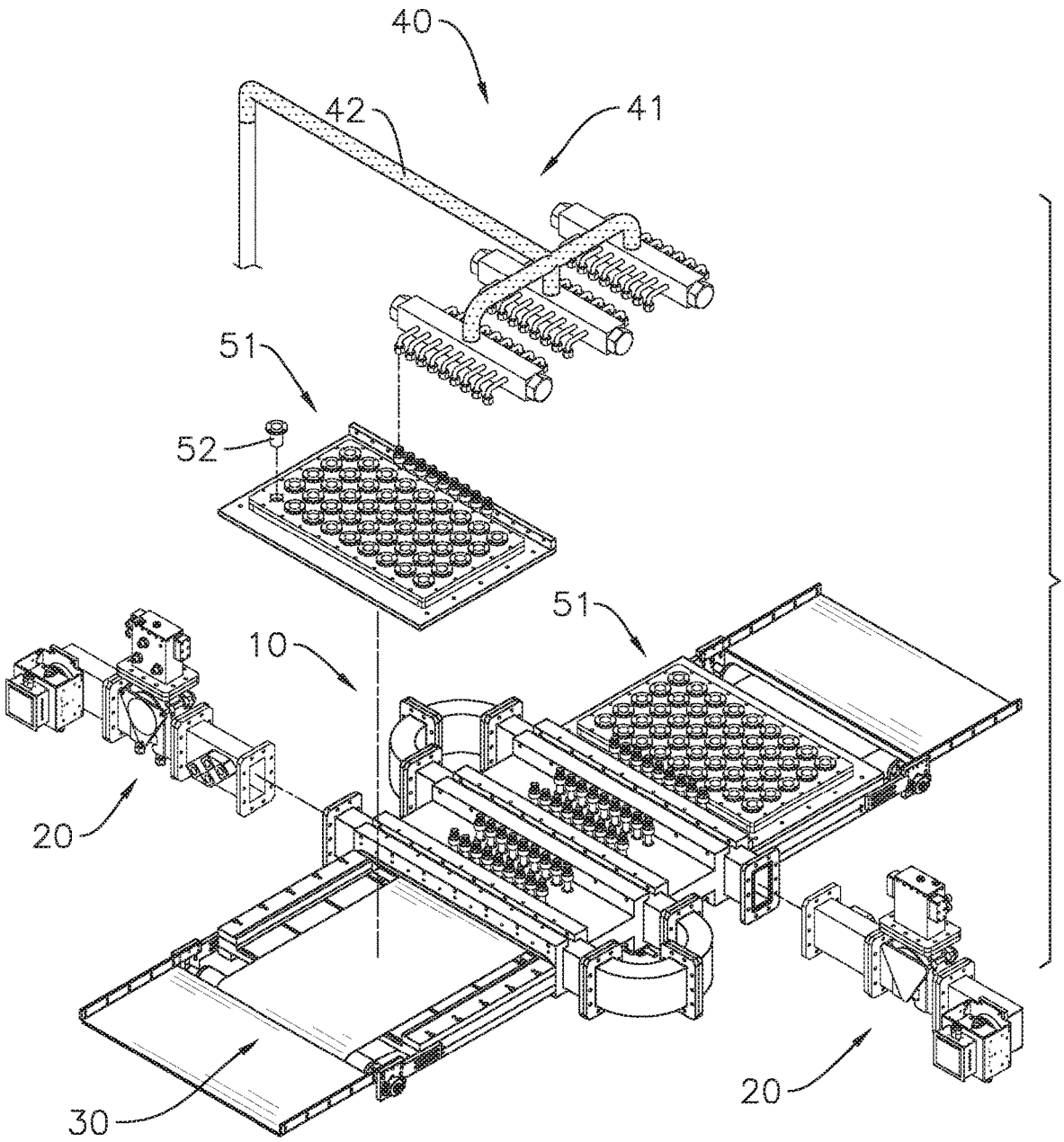
FIG. 2 is an exploded perspective view of the microwave heating device in FIG. 1.

With reference to FIGS. 1, 2, and 5, the suction module 40 communicates with an interior of the microwave guide tube 10 and is used to extract water vapor released by the humid heated object after being heated. The suction module 40 has a tube assembly 41, a heating layer 42, and a water collecting tank 43. The tube assembly 41 is disposed above the microwave guide tube 10 and communicates with the interior of the microwave guide tube 10. The heating layer 42 is disposed around the tube assembly 41 to prevent water vapor from condensing and flowing back into the microwave guide tube 10. The water collecting tank 43 is connected to the tube assembly 41 opposite the microwave guide tube 10 to collect water condensed by water vapor in the microwave guide tube 10.

Figure 11:
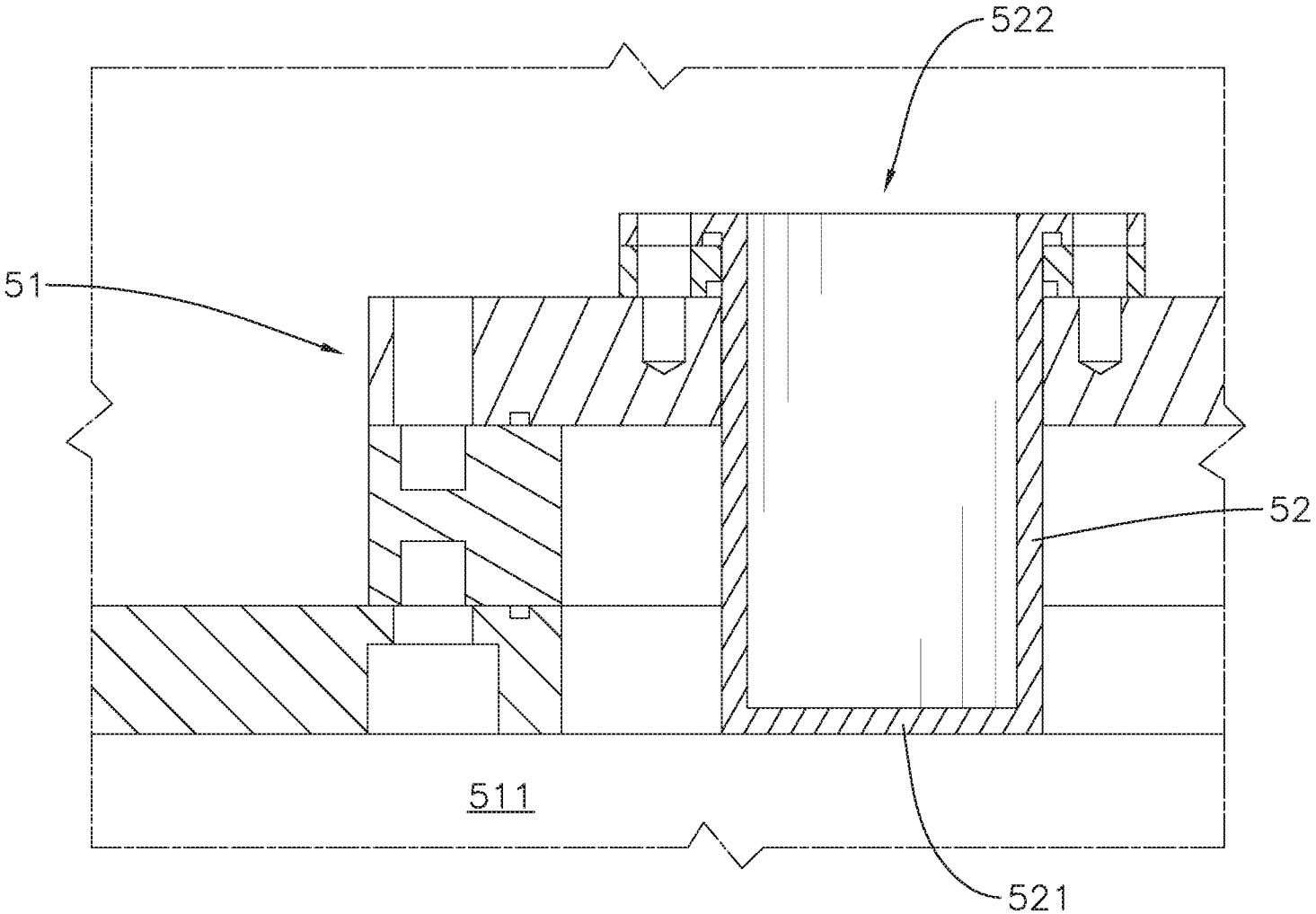
FIG. 11 is an enlarged side view of a microwave suppression element of the first embodiment of the microwave heating device in FIG. 1.

With reference to FIGS. 1, 5, and 11, the isolation module 50 has two bases 51, multiple microwave suppression elements 52, and multiple isolation flanges 53. The two bases 51 are respectively connected to two heating segments 11 respectively on the two opposite ends of the microwave guide tube 10 along the conveying direction D. Each one of the two bases 51 forms a channel 511, and the channel 511 surrounds the transmission module 30 and communicates with one of the conveying openings 131 of the responsive one of the heating segments 11. The microwave suppression elements 52 are mounted on and extend out of a top surface of each one of the two bases 51. Each microwave suppression element 52 is a tube, and two ends of the microwave suppression element 52 are respectively a closed end 521 and an open end 522. With reference to FIG. 11, the open end 522 of the microwave suppression element protrudes from the top surface of the responsive one of the two bases 51. The closed end 521 of the microwave suppression element 52 is disposed in the channel 511 of the responsive one of the two bases 51. The microwave suppressing elements 52 can restrict the microwave passing through the channel 511 and further prevent the microwave of the microwave guide tube 10 from leaking from the conveying openings 131 to the outside. The microwave suppressing elements 52 are not limited to extend through the top surface of the two bases 51, and may be extended through any outer side surface of the two bases 51. With reference to FIG. 3, each one of the multiple isolation flanges 53 is connected between two adjacent ones of the heating segments 11, and the two opposite openings of the isolation flange 53 are respectively connected to the conveying openings 131 of the two adjacent heating segments 11 toward each other to avoid microwave leakage.

Figure 12:
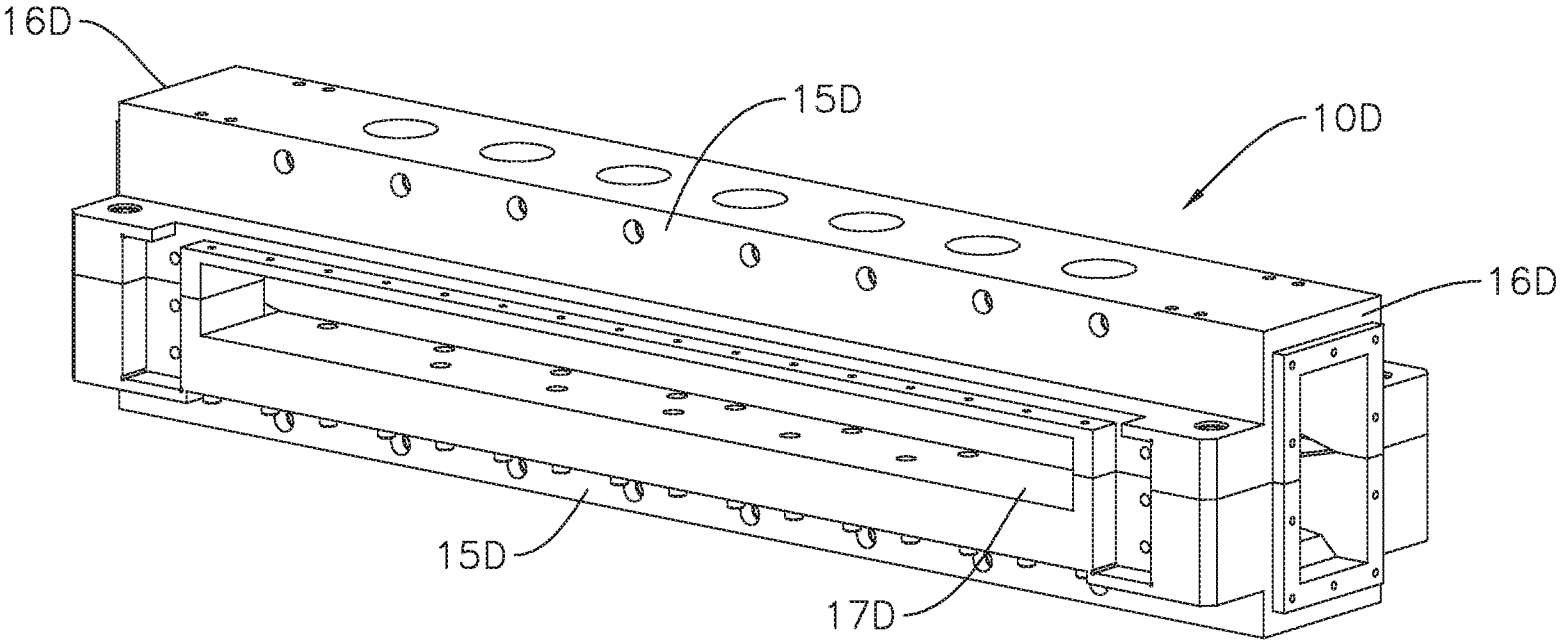
FIG. 12 is an enlarged perspective view of a microwave guiding tube of a fifth embodiment of a microwave heating device in accordance with the present invention.
Figure 13:
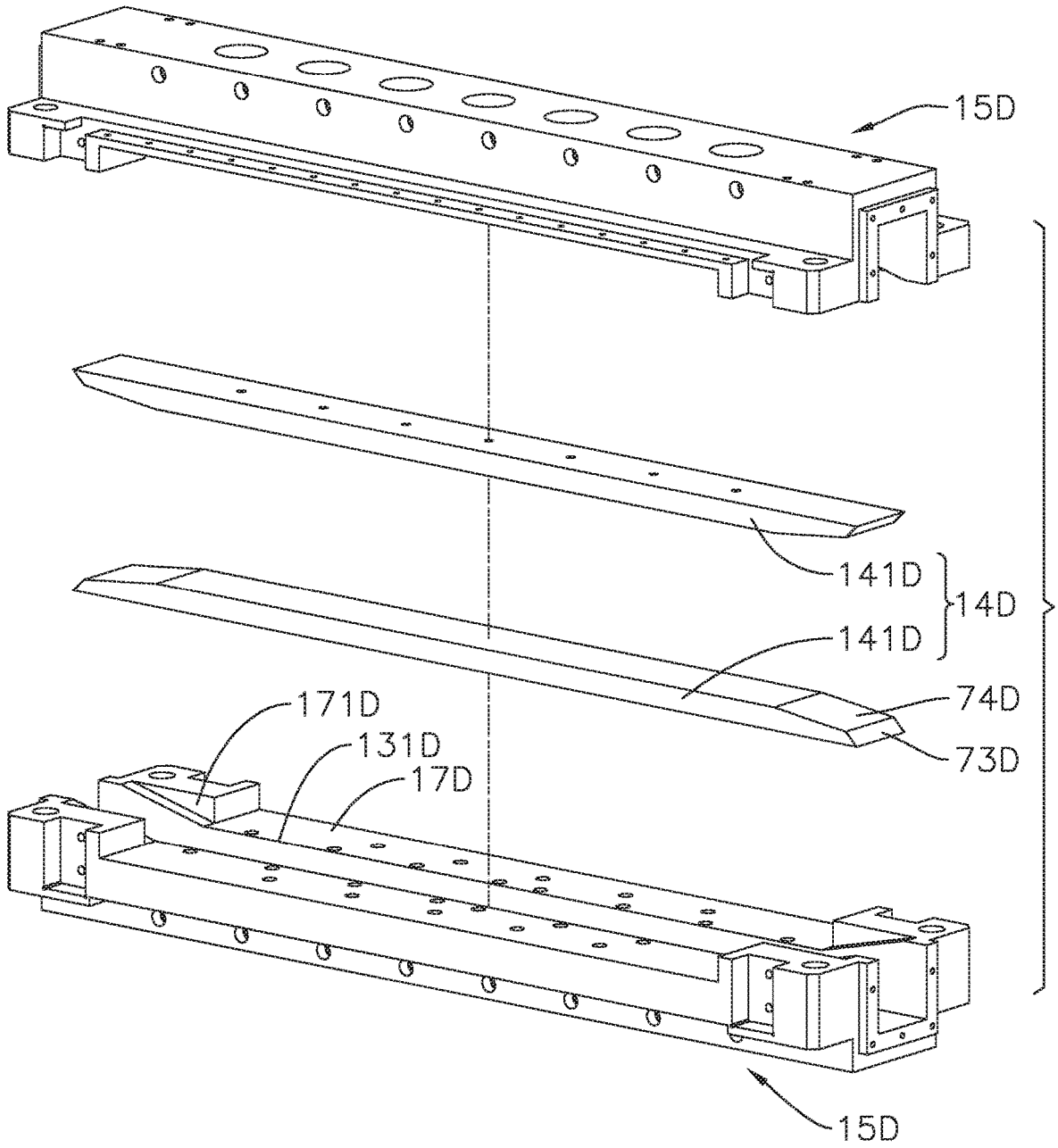
FIG. 13 is an exploded perspective view of the microwave guide tube of the fifth embodiment of the microwave heating device in FIG. 12.
Figure 14:
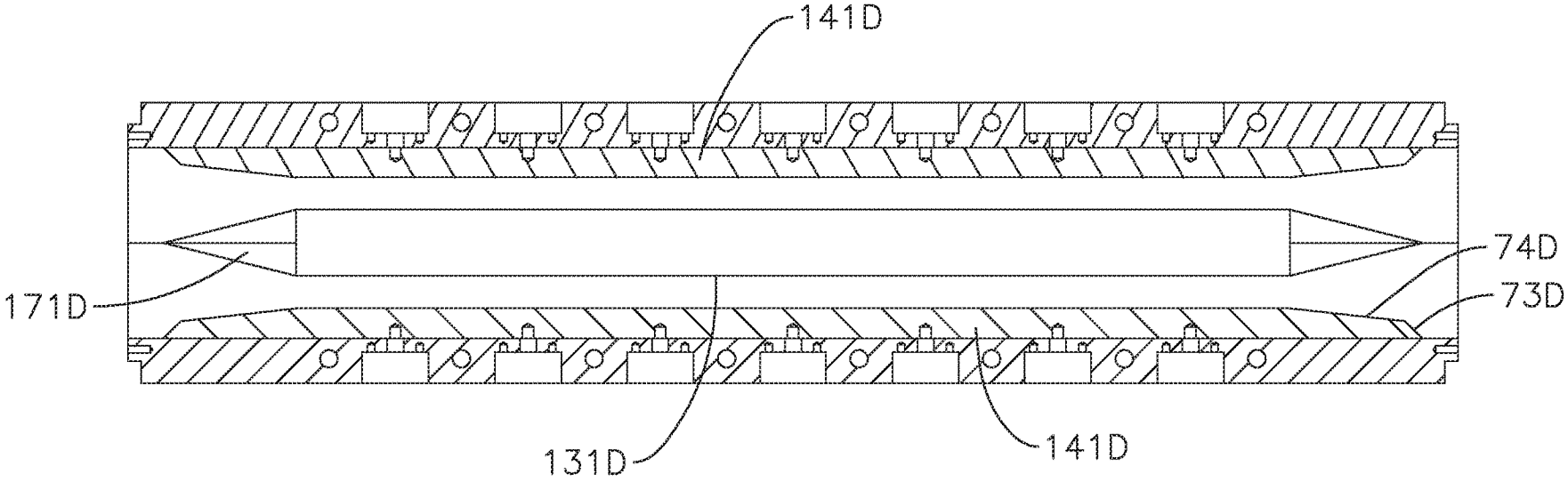
FIG. 14 is a side view of the microwave guide tube of the fifth embodiment of the microwave heating device in FIG. 12.

With reference to FIGS. 12 to 14, in a fifth embodiment of the present invention, the microwave guide tube 10D is a straight tube formed by combining two blocks 15D, and the two ends of each one of the two blocks 15D are respectively two mounting ends 16D of one of the microwave transmitting modules 20. The microwave guide tube 10D has multiple waveguide plate pairs 14D with multi-vertex structure. Each of the waveguide plates 141D of each waveguide plate pair 14D has a first inclined face 73D and a second inclined face 74D. Each conveying opening 131D has a guide annular wall 17D protruded from an outer peripheral edge of the conveying opening 131D. The guide annular wall 17D surrounds the conveying opening 131D and has a shielding surface 171D formed to shield two opposite ends of the conveying opening 131D to reduce microwave leaks.

With reference to FIGS. 1 and 5, when the present invention is in use, a heated object is placed on one end of the transmission module 30, and the transmission module 30 drives the heated object to move along the conveying direction D relative to the microwave guide tube 10. The heated object moves in the interior of the microwave guide tube 10 via the conveying openings 131. The heated object is absorbed and heated by the microwave energy in the microwave guide tube 10. When the present invention is used for heating and dehydrating the wet heated object, the suction module 40 extracts the water vapor released by the heated object and stores it in the water collecting tank 43.

In summary, the present invention provides a microwave transmitting module 20 at each one of the two opposite ends of the microwave guide tube 10 to improve the uniformity of the heating of the high microwave absorbing material in the microwave guide tube 10, and can improve the heat treatment of the heated object of high unit price.

Even though numerous characteristics and advantages of the present invention have been set forth in the foregoing descriptions, together with details of the structure and function of the present invention, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A microwave heating device comprising:

a microwave guide tube forming a wave travelling path and having at least one heating segment and each one of the at least one heating segment having a front opening wall;

a rear opening wall disposed at a spaced interval with the front opening wall along a conveying direction;

a top wall connected to the front opening wall and the rear opening wall; and a bottom wall connected to the front opening wall and the rear opening wall and facing the top wall;

at least one conveying opening pair, and each one of the at least one conveying opening pair having two conveying openings respectively formed through the front opening wall and the rear opening wall of the at least one heating segment;

at least one waveguide plate pair disposed in the at least one heating segment, and each one of the at least one waveguide plate pair having a position corresponding to a position of the at least one conveying opening pair along the wave travelling path; and two waveguide plates respectively disposed on the top wall and the bottom wall of the at least one heating segment, extending along the wave travelling path, and made of a dielectric material;

two microwave transmitting modules respectively disposed on two opposite ends of the microwave guide tube along the wave travelling path; and a transmission module extending through the at least one conveying opening pair along the conveying direction.

2. The microwave heating device as claimed in claim 1, wherein each conveying opening of the microwave guide tube has a top peripheral edge;

a bottom peripheral edge facing to the top peripheral edge at a spaced interval; and a distance between the top peripheral edge and the bottom peripheral edge being defined as an opening width of the conveying opening, and the opening widths at two opposite ends of the conveying opening along the wave travelling path being respectively tapered.

3. The microwave heating device as claimed in claim 2, wherein each conveying opening of the microwave guide tube has a middle line, and the top peripheral edge and the bottom peripheral edge of the conveying opening are disposed respectively on two sides of the middle line;

the top peripheral edge of each conveying opening has a top main segment extending along the wave travelling path; and two first upper straight segments respectively disposed on two opposite ends of the top main segment;

the bottom peripheral edge of each conveying opening has a bottom main segment extending along the wave travelling path; and two first lower straight segments respectively disposed on two opposite ends of the bottom main segment; and wherein the first upper straight segment at each one of the opposite ends of the top main segment along the wave travelling path extends toward the middle line, and the first lower straight segment at each one of the opposite ends of the bottom main segment along the wave travelling path extends toward the middle line and is connected to the first upper straight segment that is disposed at one of the opposite ends of the top main segment that is same as the opposite end of the bottom main segment.

4. The microwave heating device as claimed in claim 3, wherein the top peripheral edge of each conveying opening has two second upper straight segments, and each one of the two second upper straight segments is disposed between the top main segment and one of the two first upper straight segments;

the bottom peripheral edge of each conveying opening has two second lower straight segments, and each one of the two second lower straight segments is disposed between the bottom main segment and one of the two first lower straight segments;

an angle between one of the two first upper straight segments and the middle line is larger than an angle between an extending line of a responsive one of the two second upper straight segments and the middle line; and an angle between one of the two first lower straight segments and the middle line is larger than an angle between an extending line of a responsive one of the two second lower straight segments and the middle line.

5. The microwave heating device as claimed in claim 2, wherein each conveying opening of the microwave guide tube has a middle line, and the top peripheral edge and the bottom peripheral edge of the conveying opening are disposed respectively on two sides of the middle line;

the top peripheral edge of each conveying opening has a top main segment extending along the wave travelling path; and two first upper arc segments respectively disposed on two opposite ends of the top main segment;

the bottom peripheral edge of each conveying opening has a bottom main segment extending along the wave travelling path; and two first lower arc segments respectively disposed on two opposite ends of the bottom main segment; and wherein the first upper arc segment at each one of the opposite ends of the top main segment along the wave travelling path extends toward the middle line, and the first lower arc segment at each one of the opposite ends of the bottom main segment along the wave travelling path extends toward the middle line and is connected to the first upper arc segment that is disposed at one of the opposite ends of the top main segment that is same as the opposite end of the bottom main segment.

6. The microwave heating device as claimed in claim 2, wherein each conveying opening of the microwave guide tube has a middle line, and the top peripheral edge and the bottom peripheral edge of the conveying opening are disposed respectively on two sides of the middle line;

the top peripheral edge of each conveying opening has a top main segment extending along the wave travelling path; and two upper stepped segments respectively disposed on two opposite ends of the top main segment;

the bottom peripheral edge of each conveying opening has a bottom main segment extending along the wave travelling path; and two lower stepped segments respectively disposed on two opposite ends of the bottom main segment; and wherein the upper stepped segment at each one of the opposite ends of the top main segment along the wave travelling path extends toward the middle line, and the lower stepped segment at each one of the opposite ends of the bottom main segment along the wave travelling path extends toward the middle line and is connected to the upper stepped segment that is disposed at one of the opposite ends of the top main segment that is same as the opposite end of the bottom main segment.

7. The microwave heating device as claimed in claim 1, wherein each one of the two waveguide plates of the at least one waveguide plate pair has two opposite ends, and a thickness of each one of the two opposite ends of the waveguide plate is gradually reduced.

8. The microwave heating device as claimed in claim 7, wherein each waveguide plate has two sides;

an abutting face disposed on one of the two sides of the waveguide plate that is connected to the microwave guide tube and extending along the wave travelling path;

a main face disposed on the other one of the two sides of the waveguide plate along the wave travelling path and having a length shorter than a length of the abutting face along the wave travelling path; and two first inclined faces respectively connected to two sides of the main face and respectively extending to two sides of the abutting face to form the two opposite ends of the waveguide plate along the wave travelling path.

9. The microwave heating device as claimed in claim 8, wherein each waveguide plate has two second inclined faces, each one of the second inclined faces is disposed between one of the first inclined faces and the main face; and a degree of tilt of each second inclined face of each waveguide plate relative to the abutting face is lesser than that of each first inclined face of the waveguide plate relative to the abutting face.

10. The microwave heating device as claimed in claim 7, wherein each waveguide plate has two sides;

an abutting face disposed on one of the two sides of the waveguide plate that is connected to the microwave guide tube and extending along the wave travelling path;

a main face disposed on the other one of the two sides of the waveguide plate along the wave travelling path and having a length shorter than a length of the abutting face along the wave travelling path; and two curved faces respectively connected to two sides of the main face and respectively extending to two sides of the abutting face to form the two opposite ends of the waveguide plate along the wave travelling path.

11. The microwave heating device as claimed in claim 7, wherein each waveguide plate has two sides;

an abutting face disposed on one of the two sides of the waveguide plate that is connected to the microwave guide tube and extending along the wave travelling path;

a main face disposed on the other one of the two sides of the waveguide plate along the wave travelling path and having a length shorter than a length of the abutting face along the wave travelling path; and two stepped faces respectively connected to two sides of the main face and respectively extending to two sides of the abutting face to form the two opposite ends of the waveguide plate along the wave travelling path.

12. The microwave heating device as claimed in claim 1, wherein the microwave heating device has a suction module communicating with an interior of the microwave guide tube and having a beating layer disposed around an outer side of the suction module.

13. The microwave heating device as claimed in claim 2, wherein the microwave heating device has a suction module communicating with an interior of the microwave guide tube and having a heating layer disposed around an outer side of the suction module.

14. The microwave heating device as claimed in claim 3, wherein the microwave heating device has a suction module communicating with an interior of the microwave guide tube and having a heating layer disposed around an outer side of the suction module.

15. The microwave heating device as claimed in claim 4, wherein the microwave heating device has a suction module communicating with an interior of the microwave guide tube and having a heating layer disposed around an outer side of the suction module.

16. The microwave heating device as claimed in claim 5, wherein the microwave heating device has a suction module communicating with an interior of the microwave guide tube and having a heating layer disposed around an outer side of the suction module.

17. The microwave heating device as claimed in claim 6, wherein the microwave heating device has a suction module communicating with an interior of the microwave guide tube and having a heating layer disposed around an outer side of the suction module.

18. The microwave heating device as claimed in claim 7, wherein the microwave heating device has a suction module communicating with an interior of the microwave guide tube and having a heating layer disposed around an outer side of the suction module.

19. The microwave heating device as claimed in claim 8, wherein the microwave heating device has a suction module communicating with an interior of the microwave guide tube and having a heating layer disposed around an outer side of the suction module.

20. The microwave heating device as claimed in claim 9, wherein the microwave heating device has a suction module communicating with an interior of the microwave guide tube and having a heating layer disposed around an outer side of the suction module.

21. The microwave heating device as claimed in claim 10, wherein the microwave heating device has a suction module communicating with an interior of the microwave guide tube and having a heating layer disposed around an outer side of the suction module.

22. The microwave heating device as claimed in claim 11, wherein the microwave heating device has a suction module communicating with an interior of the microwave guide tube and having a heating layer disposed around an outer side of the suction module.

23. The microwave heating device as claimed in claim 12, wherein the suction module has a water collecting tank.

24. The microwave heating device as claimed in claim 13, wherein the suction module has a water collecting tank.

25. The microwave heating device as claimed in claim 14, wherein the suction module has a water collecting tank.

26. The microwave heating device as claimed in claim 15, wherein the suction module has a water collecting tank.

27. The microwave heating device as claimed in claim 16, wherein the suction module has a water collecting tank.

28. The microwave heating device as claimed in claim 17, wherein the suction module has a water collecting tank.

29. The microwave heating device as claimed in claim 18, wherein the suction module has a water collecting tank.

30. The microwave heating device as claimed in claim 19, wherein the suction module has a water collecting tank.

31. The microwave heating device as claimed in claim 20, wherein the suction module has a water collecting tank.

32. The microwave heating device as claimed in claim 21, wherein the suction module has a water collecting tank.

33. The microwave heating device as claimed in claim 22, wherein the suction module has a water collecting tank.

34. The microwave heating device as claimed in claim 1, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

35. The microwave heating device as claimed in claim 2, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

36. The microwave heating device as claimed in claim 3, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

37. The microwave heating device as claimed in claim 4, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

38. The microwave heating device as claimed in claim 5, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

39. The microwave heating device as claimed in claim 6, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

40. The microwave heating device as claimed in claim 7, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

41. The microwave heating device as claimed in claim 8, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

42. The microwave heating device as claimed in claim 9, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

43. The microwave heating device as claimed in claim 10, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

44. The microwave heating device as claimed in claim 11, wherein the microwave heating device has at least one isolation module, and each one of the at least one isolation module has a base connected to the microwave guide tube and having a channel surrounding the transmission module and communicating with one of the conveying openings of the microwave guide tube; and multiple microwave suppression elements mounted on and extended out of an outer side of the base, and each one of the microwave suppression elements being a tube and having an open end protruding out of the base; and a closed end disposed in the channel of the base.

45. The microwave heating device as claimed in claim 1, wherein a direction of a microwave electric field between the two waveguide plates of the at least one waveguide plate pair is parallel to the conveying direction.

46. The microwave heating device as claimed in claim 2, wherein a direction of a microwave electric field between the two waveguide plates of the at least one waveguide plate pair is parallel to the conveying direction.

47. The microwave heating device as claimed in claim 3, wherein a direction of a microwave electric field between the two waveguide plates of the at least one waveguide plate pair is parallel to the conveying direction.

48. The microwave heating device as claimed in claim 4, wherein a direction of a microwave electric field between the two waveguide plates of the at least one waveguide plate pair is parallel to the conveying direction.

49. The microwave heating device as claimed in claim 5, wherein a direction of a microwave electric field between the two waveguide plates of the at least one waveguide plate pair is parallel to the conveying direction.

50. The microwave heating device as claimed in claim 6, wherein a direction of a microwave electric field between the two waveguide plates of the at least one waveguide plate pair is parallel to the conveying direction.

51. The microwave heating device as claimed in claim 7, wherein a direction of a microwave electric field between the two waveguide plates of the at least one waveguide plate pair is parallel to the conveying direction.

52. The microwave heating device as claimed in claim 8, wherein a direction of a microwave electric field between the two waveguide plates of the at least one waveguide plate pair is parallel to the conveying direction.

53. The microwave heating device as claimed in claim 9, wherein a direction of a microwave electric field between the two waveguide plates of the at least one waveguide plate pair is parallel to the conveying direction.

54. The microwave heating device as claimed in claim 10, wherein a direction of a microwave electric field between the two waveguide plates of the at least one waveguide plate pair is parallel to the conveying direction.

55. The microwave heating device as claimed in claim 11, wherein a direction of a microwave electric field between the two waveguide plates of the at least one waveguide plate pair is parallel to the conveying direction.

56. A microwave guide tube of a microwave heating device comprising:

at least one heating segment, and each one of the at least one heating segment having a front opening wall;

a rear opening wall disposed at a spaced interval with the front opening wall along a conveying direction;

a top wall connected to the front opening wall and the rear opening wall; and a bottom wall connected to the front opening wall and the rear opening wall and facing the top wall;

at least one conveying opening pair, and each one of the at least one conveying opening pair having two conveying openings respectively formed through the front opening wall and the rear opening wall of the at least one heating segment;

at least one waveguide plate pair disposed in the at least one heating segment, and each one of the at least one waveguide plate pair having a position corresponding to a position of the at least one conveying opening pair along the wave travelling path; and two waveguide plates respectively disposed on the top wall and the bottom wall of the at least one heating segment, extending along the wave travelling path, and made of a dielectric material.

57. The microwave guide tube of the microwave heating device as claimed in claim 56, wherein each conveying opening of the microwave guide tube has a top peripheral edge;

a bottom peripheral edge facing to the top peripheral edge at a spaced interval; and a distance between the top peripheral edge and the bottom peripheral edge being defined as an opening width of the conveying opening, and the opening widths at two opposite ends of the conveying opening along the wave travelling path being respectively tapered.

58. The microwave guide tube of the microwave heating device as claimed in claim 57, wherein each conveying opening of the microwave guide tube has a middle line, and the top peripheral edge and the bottom peripheral edge of the conveying opening are disposed respectively on two sides of the middle line;

the top peripheral edge of each conveying opening has a top main segment extending along the wave travelling path; and two first upper straight segments respectively disposed on two opposite ends of the top main segment;

the bottom peripheral edge of each conveying opening has a bottom main segment extending along the wave travelling path; and two first lower straight segments respectively disposed on two opposite ends of the bottom main segment; and wherein the first upper straight segment at each one of the opposite ends of the top main segment along the wave travelling path extends toward the middle line, and the first lower straight segment at each one of the opposite ends of the bottom main segment along the wave travelling path extends toward the middle line and is connected to the first upper straight segment that is disposed at one of the opposite ends of the top main segment that is same as the opposite end of the bottom main segment.

59. The microwave guide tube of the microwave heating device as claimed in claim 58, wherein the top peripheral edge of each conveying opening has two second upper straight segments, and each one of the two second upper straight segments is disposed between the top main segment and one of the two first upper straight segments;

the bottom peripheral edge of each conveying opening has two second lower straight segments, and each one of the two second lower straight segments is disposed between the bottom main segment and one of the two first lower straight segments;

an angle between one of the two first upper straight segments and the middle line is larger than an angle between an extending line of a responsive one of the two second upper straight segments and the middle line; and an angle between one of the two first lower straight segments and the middle line is larger than an angle between an extending line of a responsive one of the two second lower straight segments and the middle line.

60. The microwave guide tube of the microwave heating device as claimed in claim 57, wherein each conveying opening of the microwave guide tube has a middle line, and the top peripheral edge and the bottom peripheral edge of the conveying opening are disposed respectively on two sides of the middle line;

the top peripheral edge of each conveying opening has a top main segment extending along the wave travelling path; and two first upper arc segments respectively disposed on two opposite ends of the top main segment;

the bottom peripheral edge of each conveying opening has a bottom main segment extending along the wave travelling path; and two first lower arc segments respectively disposed on two opposite ends of the bottom main segment; and wherein the first upper arc segment at each one of the opposite ends of the top main segment along the wave travelling path extends toward the middle line, and the first lower arc segment at each one of the opposite ends of the bottom main segment along the wave travelling path extends toward the middle line and is connected to the first upper arc segment that is disposed at one of the opposite ends of the top main segment that is same as the opposite end of the bottom main segment.

61. The microwave guide tube of the microwave heating device as claimed in claim 57, wherein each conveying opening of the microwave guide tube has a middle line, and the top peripheral edge and the bottom peripheral edge of the conveying opening are disposed respectively on two sides of the middle line;

the top peripheral edge of each conveying opening has a top main segment extending along the wave travelling path; and two upper stepped segments respectively disposed on two opposite ends of the top main segment;

the bottom peripheral edge of each conveying opening has a bottom main segment extending along the wave travelling path; and two lower stepped segments respectively disposed on two opposite ends of the bottom main segment; and wherein the upper stepped segment at each one of the opposite ends of the top main segment along the wave travelling path extends toward the middle line, and the lower stepped segment at each one of the opposite ends of the bottom main segment along the wave travelling path extends toward the middle line and is connected to the upper stepped segment that is disposed at one of the opposite ends of the top main segment that is same as the opposite end of the bottom main segment.

62. The microwave guide tube of the microwave heating device as claimed in claim 56, wherein each one of the two waveguide plates of the at least one waveguide plate pair has two opposite ends, and a thickness of each one of the two opposite ends of the waveguide plate is gradually reduced.

63. The microwave guide tube of the microwave heating device as claimed in claim 62, wherein each waveguide plate has two sides;

an abutting face disposed on one of the two sides of the waveguide plate that is connected to the microwave guide tube and extending along the wave travelling path;

a main face disposed on the other one of the two sides of the waveguide plate along the wave travelling path and having a length shorter than a length of the abutting face along the wave travelling path; and two first inclined faces respectively connected to two sides of the main face and respectively extending to two sides of the abutting face to form the two opposite ends of the waveguide plate along the wave travelling path.

64. The microwave guide tube of the microwave heating device as claimed in claim 63, wherein each waveguide plate has two second inclined faces, each one of the second inclined faces is disposed between one of the first inclined faces and the main face; and a degree of tilt of each second inclined face of each waveguide plate relative to the abutting face is lesser than that of each first inclined face of the waveguide plate relative to the abutting face.

65. The microwave guide tube of the microwave heating device as claimed in claim 62, wherein each waveguide plate has two sides;

an abutting face disposed on one of the two sides of the waveguide plate that is connected to the microwave guide tube and extending along the wave travelling path;

a main face disposed on the other one of the two sides of the waveguide plate along the wave travelling path and having a length shorter than a length of the abutting face along the wave travelling path; and two curved faces respectively connected to two sides of the main face and respectively extending to two sides of the abutting face to form the two opposite ends of the waveguide plate along the wave travelling path.

66. The microwave guide tube of the microwave heating device as claimed in claim 62, wherein each waveguide plate has two sides;

an abutting face disposed on one of the two sides of the waveguide plate that is connected to the microwave guide tube and extending along the wave travelling path;

a main face disposed on the other one of the two sides of the waveguide plate along the wave travelling path and having a length shorter than a length of the abutting face along the wave travelling path; and two stepped faces respectively connected to two sides of the main face and respectively extending to two sides of the abutting face to form the two opposite ends of the waveguide plate along the wave travelling path.

67. The microwave guide tube of the microwave heating device as claimed in claim 57, wherein a direction of a microwave electric field between the two waveguide plates of the at least one waveguide plate pair is parallel to the conveying direction.

68. The microwave guide tube of the microwave heating device as claimed in claim 58, wherein a direction of a microwave electric field between the two waveguide plates of the at least one waveguide plate pair is parallel to the conveying direction.

69. The microwave guide tube of the microwave heating device as claimed in claim 59, wherein a direction of a microwave electric field between the two waveguide plates of the at least one waveguide plate pair is parallel to the conveying direction.

70. The microwave guide tube of the microwave heating device as claimed in claim 60, wherein a direction of a microwave electric field between the two waveguide plates of the at least one waveguide plate pair is parallel to the conveying direction.

71. The microwave guide tube of the microwave heating device as claimed in claim 61, wherein a direction of a microwave electric field between the two waveguide plates of the at least one waveguide plate pair is parallel to the conveying direction.

72. The microwave guide tube of the microwave heating device as claimed in claim 62, wherein a direction of a microwave electric field between the two waveguide plates of the at least one waveguide plate pair is parallel to the conveying direction.

73. The microwave guide tube of the microwave heating device as claimed in claim 63, wherein a direction of a microwave electric field between the two waveguide plates of the at least one waveguide plate pair is parallel to the conveying direction.

74. The microwave guide tube of the microwave heating device as claimed in claim 64, wherein a direction of a microwave electric field between the two waveguide plates of the at least one waveguide plate pair is parallel to the conveying direction.

75. The microwave guide tube of the microwave heating device as claimed in claim 65, wherein a direction of a microwave electric field between the two waveguide plates of the at least one waveguide plate pair is parallel to the conveying direction.

76. The microwave guide tube of the microwave heating device as claimed in claim 56, wherein a direction of a microwave electric field between the two waveguide plates of the at least one waveguide plate pair is parallel to the conveying direction.

* * * * *